United States Patent [19]

Vomhof et al.

[11] Patent Number: 4,696,434

[45] Date of Patent: Sep. 29, 1987

[54] CUTTER HEAD FOR MEAT CUTTER

[75] Inventors: Paul Vomhof, Bad Laasphe; Karlheinz Schmidt, Steffenberg-Quotshausen; Peter Oster, Biedenkopf-Wallau, all of Fed. Rep. of Germany

[73] Assignee: Kramer & Grebe GmbH & Co. KG, Biedenkopf-Wallau, Fed. Rep. of Germany

[21] Appl. No.: 864,132

[22] Filed: May 16, 1986

[30] Foreign Application Priority Data

May 23, 1985 [DE] Fed. Rep. of Germany ..... 3518530

[51] Int. Cl.[4] ..... B02C 18/18

[52] U.S. Cl. ..... 241/282.2

[58] Field of Search ..... 30/276, 299, 300, 303, 30/304, 308, 310, 347; 83/665, 666, 668; 241/282.1, 282.2, 292.1, 292

[56] References Cited

U.S. PATENT DOCUMENTS 2,917,091 12/1959 Smith et al. ..... 241/292.1 X
3,730,363 5/1973 Karpf ..... 241/292.1 X
4,294,415 10/1981 Wetter et al. ..... 241/292

FOREIGN PATENT DOCUMENTS 1052849 5/1959 Fed. Rep. of Germany ... 241/292.1

*Primary Examiner*—Donald R. Schran
*Assistant Examiner*—Michael D. Folkerts
*Attorney, Agent, or Firm*—Browdy and Neimark

[57] ABSTRACT

A cutter head for a meat cutter having several cutters fastened to securing disks by means of securing bolts includes at least one toothed area on the front of the securing disk into which a front toothing of a securing bolt can be positively locked. The cutters can be positively fastened and locked onto the securing disk, while the cutters can be adjusted in the radial direction. The staggering of the front toothing of the securing bolts by one-half the width of a tooth towards the center of the bolt makes it possible to adjust the cutters radially by one-half the width of the bolt. A counterbalance disk, fastened to the securing disk, is provided with bores to contain counterweights. The counterbalance disk has two shoulders for the lateral guidance of the cutter. Two cutters or a cutter and a filler disk can be positioned opposite each other in the same plane.

13 Claims, 5 Drawing Figures

CUTTER HEAD FOR MEAT CUTTER

FIELD OF THE INVENTION

The present invention relates to a cutter head for a meat cutter having several cutter knives radially adjustable and fastened to securing disks by means of securing bolts, the securing disks being positively locked to the cutter shaft.

BACKGROUND OF THE INVENTION

This type of cutter head is used as part of cutters mainly employed for meat chopping. The dish of the cutter, driven around its vertical axis, generally has the form of the lower half of a torus, wherein a cutter shaft driven by a motor is provided approximately tangentially to the circular axis of the torus, having a cutter head provided with cutters. To chop the material, the cutter head rotates at high speed. The distance of the cutting edges in the outer radial area from the inner wall of the cutter dish should be as small as possible in order to obtain optimal mincing of the material. For this reason the cutting edges in the outer radial area of the several cutters of a cutter set must be adjusted to central clearances which differ from each other and which are based on the curvature of the dish wall and the position of the cutter in relation to the center of the dish. A further consideration is the loss of sharpness of the cutter after a certain time of use, necessitating a re-sharpening of the cutting edges. This causes an unwanted increase of the distance from the inner wall of the dish.

Several ways to solve this problem have been proposed, however, only partial solutions have been found.

For instance, an adjustment device has been proposed with the intention of providing a continuous adjustment by means of radial screws. Because of the high rotational speed and the comparatively large mass of the cutters, very large centrifugal forces are created, which have to be absorbed by the adjustment device. However, it cannot resist these extremely great stresses over time, therefore cannot guarantee a secure mounting of the cutters.

Another way is that of German Offenlegungsschrift DE-OS No. 28 36 630, wherein a dog is provided in the area of the central bore of the cutter for receiving the cutter shaft on the side opposite from the cutting edge and which is adjacent to the cutter shaft. If the radial length of the cutter is reduced by honing, the dog is shortened accordingly in order to compensate for the reduction in radial length. The adjustment of the dog with a file, i.e., by hand, is difficult and time-consuming. Furthermore, although the dog limits the cutter sufficiently in the direction of the centrifugal force, it does not fix the cutter in a determined position.

SUMMARY OF THE INVENTION

Being aware of these disadvantages in the state of the art, the present invention is intended to provide a cutter head of the type previously described in such a way that, while the cutters are securely fastened, a radial adjustment becomes possible while the weight of the cutters remains relatively low.

This is accomplished in accordance with the present invention by providing a securing disk at the front, having at least one toothed area in connection with which a securing bolt that penetrates the cutter and is adjustable in the direction of the cutter adjustment and having a corresponding front toothing, can be employed.

In accordance with the present invention, the securing disk is provided at its front with at least one toothed area, with which a securing bolt, penetrating the cutter and adjustable in the direction of the cutter adjustment and having a corresponding front toothing, can be employed. This provides a positive locking of the cutter with the securing disk, thereby making possible a secure seat against radial displacement. The cutters no longer have to encompass the cutter shaft, therefore the amount of material as well as weight and production costs can be accordingly kept to a minimum. The cutter and the securing bolt are adjustable in a radial direction which makes possible a compensation for the abrasion of the outer cutter periphery while, at the same time, the determination of the position based on the curvature of the dish can be made.

Preferably two toothed areas, generally placed symmetrically to the central axis of the adjustment direction, are provided on the securing disk. The cutter is therefore positively locked to two areas opposite from each other, thereby allowing a better absorption of the movements in a tangential direction which occur during starting and stopping and the considerable centrifugal forces which are placed on the cutter during use.

In accordance with a preferred embodiment, four toothed areas, generally placed symmetrically to the central axis of the adjustment direction, are provided on the front of the securing disk in order to securely maintain two cutters which are opposite each other in a plane. The toothed crowns of the toothed areas preferably run mainly in a direction vertically to the adjustment direction of the cutter, so that the centrifugal forces are absorbed vertically to the direction of the tooth crowns.

In accordance with a useful embodiment of the invention, the securing bolts can be fastened to the securing disk by means of securing screws which penetrate slots provided in the securing disk. Thus the securing bolts have the shape of short cylindrical stumps provided at their front with a toothed area corresponding to that of the securing disk. The securing bolts are secured with their front toothing via securing screws to the securing areas of the securing disk. Because of the front toothing of the securing bolts is staggered by half the width of the tooth toward the center of the bolt bolt, even small additional adjustments of the cutter, by one-half the width of a tooth in a radial direction, can be made through turning the securing bolt 180° before it again engages the toothed area of the securing disk.

In accordance with an embodiment of the cutter head in accordance with the present invention a counterbalance disk is secured to the securing disk, having bores to receive counterweights on a circle of holes disposed concentrically to the center of the cutter shaft. Because of the change in the distribution of the mass caused by the honing, renewed counterbalancing becomes necessary when the cutters are readjusted. This is accomplished by means of insertion of counterweights into the bores of the counterbalance disk.

It is practical to provide the counterbalance disk with shoulders in the direction of the adjustment of the cutters, the height of which is somewhat smaller than the thickness of the foot of the cutter and the distance of which generally corresponds to the width of the cutter foot. This guarantees a guidance of the cutter on both sides in the direction of adjustment, which is advantageous when inserting the cutters and adjusting the securing bolts.

In an embodiment of the cutter head according to the present invention, two cutters can be disposed on the securing disk in a plane and opposite each other. The cutters are each fastened by means of two securing bolts in the direction of radial movement, so that the securing disk is provided with four toothed areas. Because of this symmetrical construction the centrifugal forces acting on the two cutters placed opposite each other cancel each other in general. However, one of the cutters may also be replaced by a filler disk placed in the same plane.

The securing bolts can be provided with tool access openings on their sides opposite the front toothing.

Further advantages, details and characteristics of the invention can be found in the following description of an exemplary embodiment, making reference to the enclosed drawings.

DESCRIPTION OF A PREFERRED EMBODIMENT

Figure 1:
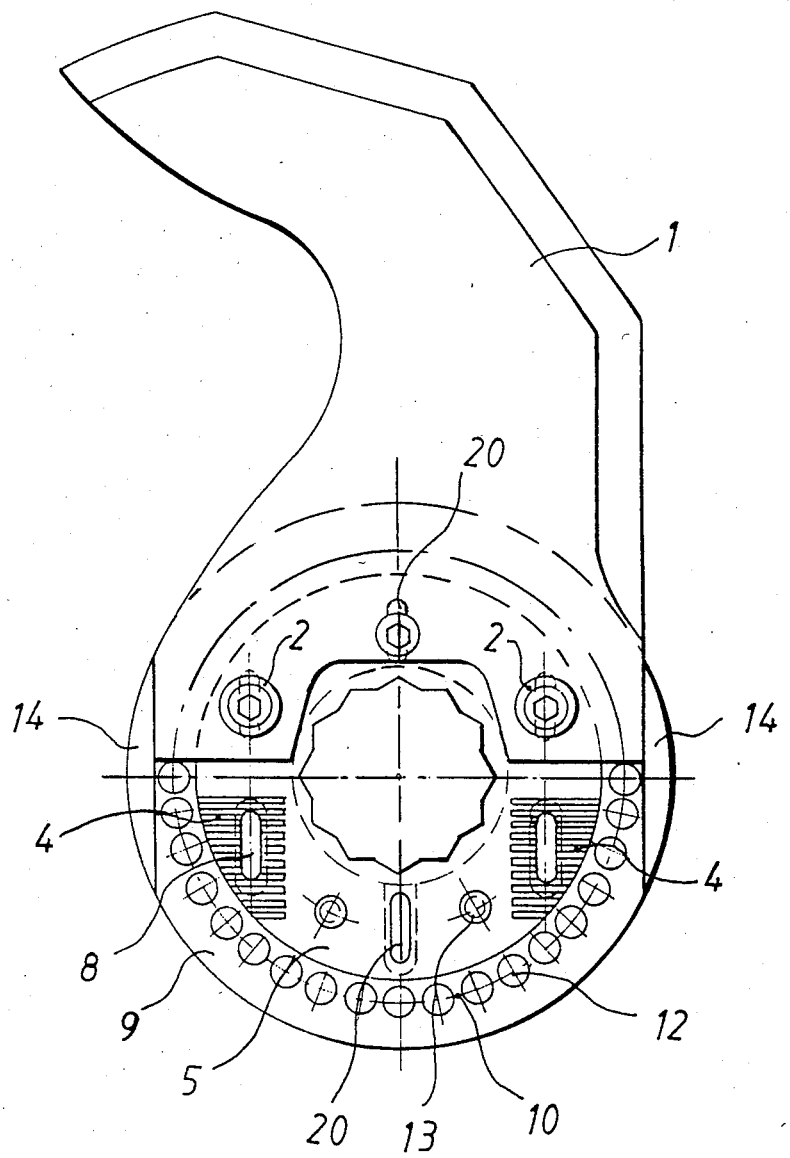
FIG. 1 is a frontal view of a cutter head in accordance with the present invention, showing a mounted cutter without opposite cutter or filler disk.
Figure 4:
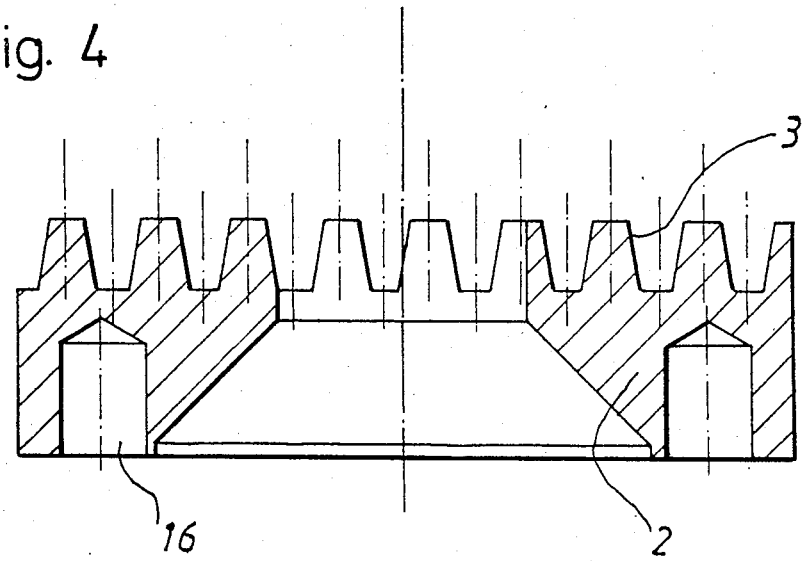
FIG. 4 is a section through a securing bolt in a very magnified view.
Figure 5:
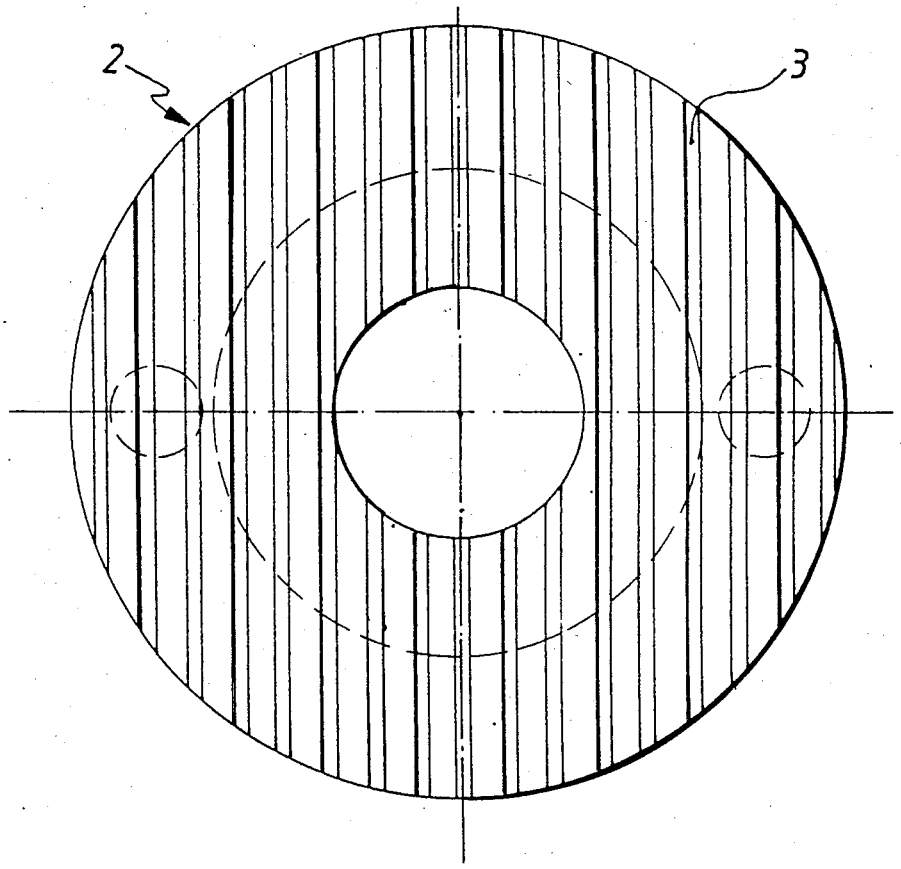
FIG. 5 is a top view of the front toothing of the securing bolt in the same magnification as FIG. 4.

FIG. 1 shows the design of the cutter 1, having a generally sickle-like shape and a cutting edge applied to the outer edge. Rotation of the cutter head in accordance with the representation in FIG. 1 is in a clockwise direction. The cutter 1 is secured in a radial direction by the securing bolts 2. The form and placement of the securing bolts 2 can be seen in detail in FIGS. 2, 4 and 5. In the preferred embodiment described herein, the securing bolts 2 are in the form of short cylindrical bodies provided on one end with a front toothing 3. FIG. 4, especially, shows that the toothing 3 is staggered by one-half the width of a tooth towards the center of the securing bolt 2. The importance of this staggering will become apparent in the course of this description.

Figure 2:
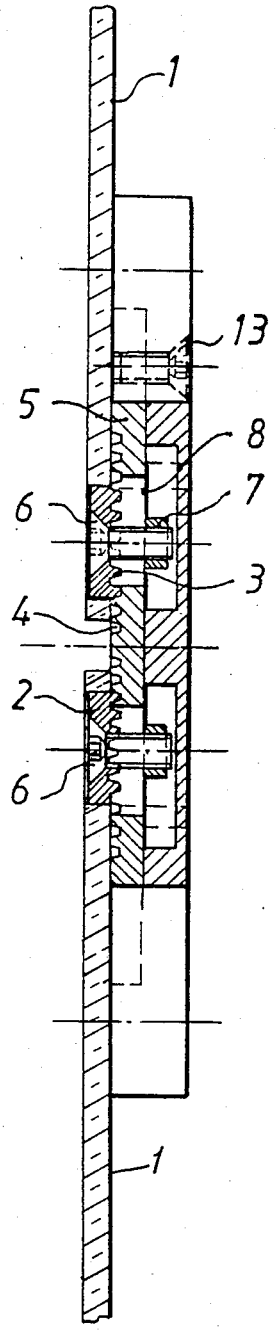
FIG. 2 is a cross section through the device of FIG. 1 in the plane of the securing bolts, showing two cutters mounted in a plane.

It can be seen from FIGS. 1 and 2 that the securing disk 5 for the cutters 1 is provided with toothed areas 4, which can be engaged with the front toothing 3 of the securing bolts 2. The securing bolts 2 are connected with the securing disk 5 by means of securing screws 6. The securing screws 6 respectively penetrate a slot 8 in the securing disk 5, wherein washers 7 are provided in a recess behind the securing disk to receive the threads of the securing screws 6.

If, because of wear or abrasion, it becomes necessary to adjust a cutter 1 in a radial direction, the securing screw 6 is loosened from the washer and the securing bolt 2 can be outwardly moved in a radial direction by one tooth. Due to the fact that the front toothing 3 of the securing bolt 2 is staggered by one-half of the width of a tooth towards the center of the securing bolt, a radial displacement by one-half the width of a tooth becomes possible if the securing bolt is rotated by 180°.

Figure 3:
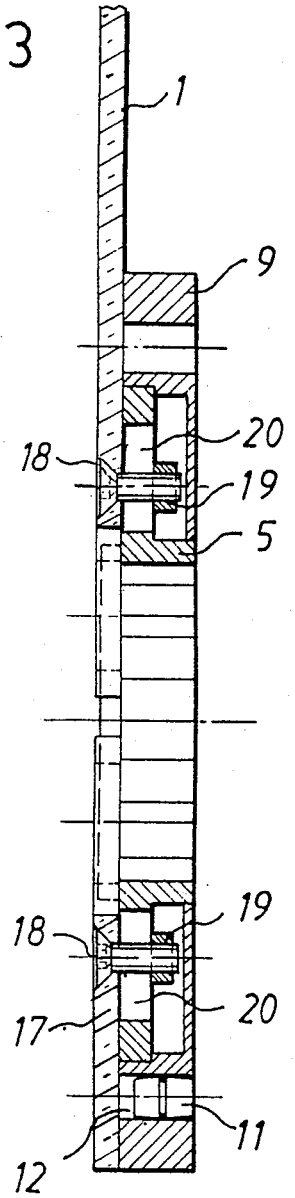
FIG. 3 is a cross section of the device through the axis of the cutter head, wherein a cutter and a filler disk are opposite each other in a plane.

As can be seen from FIG. 3, especially, the cutter 1 is held by means of a screw 18, which penetrates a slot 20 in the securing disk 5, and a corresponding washer 19, to the disk 5.

In the embodiment shown in FIG. 2, two cutters 1 have been fastened opposite each other on the securing disk 5. In contrast to this, in the embodiment shown in FIG. 3, a filler disk 17 is provided, which takes the place of the second cutter and is fastened on the securing disk 5 opposite from the first cutter. The filler disk 17, too, is fastened on the securing disk 5 by means of a screw 18 penetrating a slot 20, and a washer 19.

FIGS. 2 and 3 show that a counterbalance disk 9 is fastened on the securing disk 5 by means of screws 13. As can be clearly seen in FIG. 1, the counterbalance disk 9 has a concentric ring of holes 10 provided with several bores 12 placed adjacent each other. Counterweights 11 can be placed into the bores 12 (FIG. 3) in order to correct imbalances which might occur after the grinding of cutters 1.

FIG. 1 further shows that the counterbalance disk 9 is provided on its opposite sides with shoulders 14, the height of which is somewhat less than the thickness of the foot of the cutter 1. The distance between the two shoulders 14 generally corresponds to the width of the cutter foot. Thus the shoulders form a lateral guide for the cutter 1 in the direction of adjustment of the cutter.

To make the handling of the securing bolts 2 easier, they may be provided with tool access openings 16 on the side opposite the front toothing 3.

The above description is only provided by way of example and it is possible to provide several modifications without departing from the scope of the invention.

What is claimed is:

1. A cutter head for a meat cutter comprising
a cutter adjustable in a radial direction;
a securing disk for mounting said cutter positively locked to a rotatable shaft;
holding means allowing radial adjustment and axially securing said cutter to said securing disk;
said securing disk having at least one toothed area on a front surface of said securing disk having teeth forming grooves and ridges extending outward from the plane of said securing disk;
at least one securing bolt means for securing said cutter to said securing disk in the radial direction and penetrating an aperture in said cutter, said securing bolt means having a front toothing with grooves and ridges complementary to said toothed area of said securing disk for adjustment in the radial direction.

2. The cutter head of claim 1 wherein
a second toothed area is located on said front surface of said securing disk, said toothed areas being located symmetrically to a central axis of the direction of adjustment of said cutter.

3. The cutter head of claim 1 wherein
a second cutter adjustable in a radial direction is located on the cutter head;
said two cutters disposed opposite each other in a plane on said securing disk.

4. The cutter head of claim 3 wherein
third and fourth toothed areas are located on said front surface of said securing disk, said toothed areas placed opposite to each other and symmetrical to the central axis of the direction of adjustment of said cutter.

5. The cutter head of claim 1 wherein said grooves and ridges of said toothed area of said securing disk extend substantially normal to the direction of the cutter adjustment.

6. The cutter head of claim 1 wherein said securing disk having slots therethrough;

washers located on one side of said slots;

securing screws to fasten said securing bolt means to said securing disk with said securing screws penetrating said securing disk and attaching to said washers.

7. The cutter head of claim 6 wherein a second cutter adjustable in a radial direction is located on the cutter head;

said cutter and said second cutter being radially secured said securing disk by said securing screws and said washers with said slots extending in the adjustment direction of said cutters.

8. The cutter head of claim 1 wherein said front toothing of said securing bolt means including said grooves and ridges of said front toothing offset with respect to the center axis of said securing bolt means by one-half the width of said grooves.

9. The cutter head of claim 1 wherein said front toothing of said securing bolt means including said grooves and ridges of said front toothing offset with respect to the center axis of said securing bolt means by one-half the width of said ridges.

10. The cutter head of claim 1 wherein a counterbalance disk is fastened by means of screws to said securing disk;

said counterbalance disk having a ring of holes with bores therein placed concentrically to the center of the shaft of said cutter head;

counterweights disposed in at least some of said bores.

11. The cutter head of claim 10 wherein said counterbalance disk has shoulders extending in the direction of the adjustment of said cutter;

said shoulders being of less height than the thickness of a foot of said cutter and spaced from each other a distance corresponding to the width of said foot of said cutter.

12. The cutter head of claim 1 wherein a filler disk is located on said securing disk, opposite and in the same plane as said cutter.

13. The cutter head of claim 12 wherein said securing disk has slots therethrough extending in the adjustment direction of said cutter;

said filler disk and said cutter being fastened on said securing disk by said holding means comprising screws and washers through said slots.

* * * * *